US012187523B2

(12) United States Patent
Cicarelli

(10) Patent No.: US 12,187,523 B2
(45) Date of Patent: Jan. 7, 2025

(54) TEMPERATURE CONTROL DEVICE FOR A CONTAINER

(71) Applicant: James Cicarelli, Brigantine, NJ (US)

(72) Inventor: James Cicarelli, Brigantine, NJ (US)

( * ) Notice: Subject to any disclaimer, the term of this patent is extended or adjusted under 35 U.S.C. 154(b) by 68 days.

(21) Appl. No.: 17/822,034

(22) Filed: Aug. 24, 2022

(65) Prior Publication Data

US 2024/0067436 A1 Feb. 29, 2024

(51) Int. Cl.
*B65D 81/34* (2006.01)
*F25D 3/00* (2006.01)

(52) U.S. Cl.
CPC ..... *B65D 81/3484* (2013.01); *F25D 3/00* (2013.01); *B65D 2581/3401* (2013.01); *F25D 2303/0842* (2013.01)

(58) Field of Classification Search
CPC ..... F25D 2303/0843; F25D 2303/0842; F25D 2303/0845; F25D 31/007; F25D 31/008; F25D 3/08; F25D 3/00; B65D 81/3484; B65D 2581/3401; A47J 36/28; A47J 36/30; A47J 36/2444
See application file for complete search history.

(56) References Cited

U.S. PATENT DOCUMENTS 3,970,068 A * 7/1976 Sato ..... F25D 5/02 62/294
5,044,173 A * 9/1991 Cheng ..... F25D 3/08 62/457.3
6,134,894 A * 10/2000 Searle ..... B65D 81/3484 62/62
11,116,340 B2 * 9/2021 Cicarelli ..... A47G 19/2233
11,173,099 B2 * 11/2021 Venti ..... A61J 9/085
2002/0159247 A1 * 10/2002 Katzman ..... G09F 23/06 362/101
2005/0103739 A1 * 5/2005 Brown ..... F25D 3/08 215/6
2009/0039045 A1 * 2/2009 Chen ..... A47G 19/2266 215/6
2010/0255169 A1 * 10/2010 Coffey ..... F24V 30/00 426/523
2011/0088410 A1 * 4/2011 Negley ..... F25D 3/08 62/457.4
2013/0233866 A1 * 9/2013 Dooley ..... B65D 81/18 220/592.17
2016/0340081 A1 * 11/2016 Cicarelli ..... A47G 19/2233
2019/0261793 A1 * 8/2019 Cicarelli ..... A47G 19/2233

* cited by examiner

*Primary Examiner* — Don M Anderson
(74) *Attorney, Agent, or Firm* — Laubscher & Fretwell, P.C.

(57) ABSTRACT

A temperature control device for a container includes a base, a projection extending from the base and temperature control substance contained within an inner chamber of the projection. The base has a bottom wall, at least one side wall, and a top wall from which the projection extends. The projection includes a side wall, a bottom wall and a top wall which together define an inner chamber in which the temperature control substance is located. Preferably, the temperature control substance is one of a phase changing material or an activated carbon. The device is configured to connect with a bottom wall opening of a container to provide temperature control to the contents located within the container.

18 Claims, 6 Drawing Sheets

TEMPERATURE CONTROL DEVICE FOR A CONTAINER

BACKGROUND

The present disclosure relates generally to drink containers, and more specifically to such containers having a temperature control device.

Drinking containers come in varying forms, including varying sizes, shapes and purposes. Most includes at least a bottom wall and a side wall defining an inner chamber to contain any liquid dispensed within the container. It is desirable for the contents of a drinking container to have a temperature that differs from the surrounding environment, for example water with ice or hot coffee.

Typically when the contents of a drinking container are hotter or colder than the surrounding environment, it is also desirable to include a device or process for maintaining the temperature of the contents. This may include ice in a liquid, an insulated container, a top that prevents the contents of the container from interacting with the surrounding environment, or an electrical heating or cooling device, to name a few.

Though the above examples have their advantages, they also have drawbacks. For instance, depending on the surrounding environment, ice in a drink will normally melt, which in turn adds water to the liquid in a container. For any liquid that is not itself water, the melted ice will change the composition of the liquid in the container. For electrical devices to maintain temperature, they must remain connected with the drinking container, which may not be preferable or feasible. Effective insulated cups are typically more costly than cups that do not include insulation.

There is thus a need for an effective way to control temperature of a liquid in a drinking container that does not include the drawbacks of the above devices and processes.

SUMMARY OF THE DISCLOSURE

Accordingly, it is an object of the present disclosure to provide a temperature control device for a container which includes a base, a projection extending from the base and temperature control substance contained within an inner chamber of the projection. The base has a bottom wall, at least one side wall, and a top wall from which the projection extends. The projection includes a side wall, a bottom wall and a top wall which together define an inner chamber in which the temperature control substance is located. Preferably, the temperature control substance is one of a phase changing material or an activated carbon. The device is configured to connect with a bottom wall opening of a container to provide temperature control to the contents located within the container.

In one embodiment, the base side wall has a narrowing diameter from the bottom wall to the top wall and the projection has a generally conical configuration. Preferably, the bottom wall of the base is planar.

In a second embodiment, a portion of the projection side wall has a generally fluted configuration, and the projection top wall has one of a convex, concave and frustoconical configuration.

In another embodiment, an outer surface of the device contains an annular notch arranged to correspond with a side wall protuberance of a drink container lower end opening.

In yet another embodiment, an outer surface of the device contains a plurality of dimples arranged to correspond with a plurality of side wall protuberances of a drink container lower end opening.

In an embodiment in which the inner chamber includes an activated carbon, the base bottom wall includes a removable seal and contains at least one opening or a permeable material.

It is further an object of the present disclosure to provide a container which includes a housing having a bottom wall containing a lower end opening, at least one side wall, an open upper end defining a chamber, and a hollow projection arranged within the chamber integral with the bottom wall and extending toward the open upper end. The container further includes one of the temperature control device embodiments described above, which is configured for connection with the container lower end opening.

In one embodiment, an annular protuberance is arranged on a surface of the container hollow projection and configured for connection with an annular notch of the temperature control device, as described above.

In a second embodiment, a plurality of side wall protuberances are arranged on a surface of the container hollow projection and are configured to correspond with a plurality of dimples arranged on a surface of the temperature control device.

BRIEF DESCRIPTION OF THE FIGURES

Other objects and advantages of the invention will become apparent from a study of the following description when viewed in the light of the accompanying drawing, in which.

DETAILED DESCRIPTION

Figure 1:
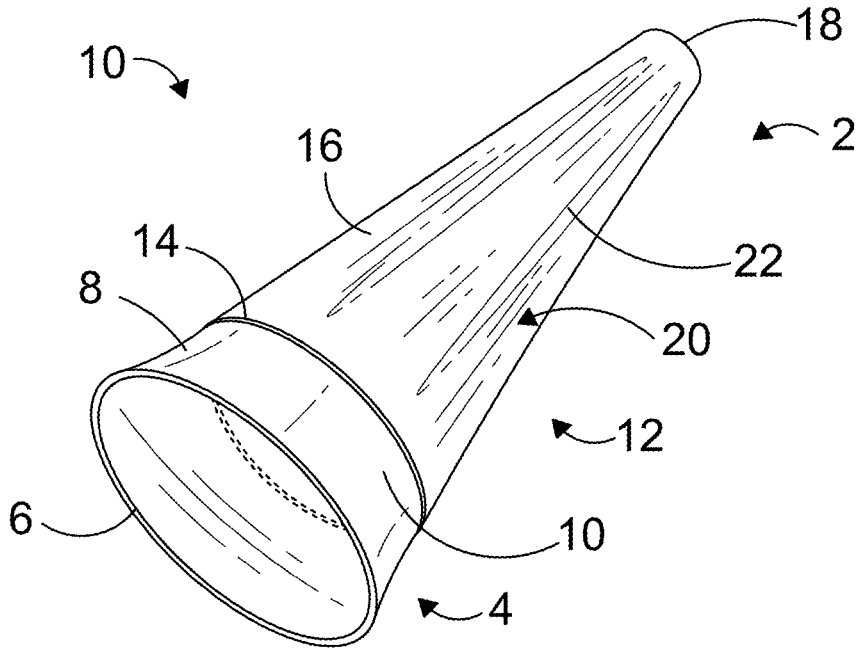
FIG. 1 is perspective view of a first embodiment of a temperature control device according to the present disclosure.

Referring first to FIG. 1, an elongated temperature control device which is configured to be inserted into a central opening of a drinking container, such as a cup or can, is shown. The device 2 includes a base 4 having a bottom wall 6, circular side wall 8, and a top wall 10. Connected with the base at its top wall, there is a projection 12 having a bottom wall 14, side wall 16, and rounded top wall 18 defining an inner chamber 20. The side wall of this embodiment has a fluted configuration designed to correspond with a drinking container projection that also has a fluted configuration (see FIG. 3). Within the inner chamber, there is material 22, such as a phase changing material that results in the device providing either a cooling or heating element. For instance, the material may be water/ice, sodium polyacrylate, salt hydrates, paraffins, activated carbon, and other similar materials.

In the embodiment of FIG. 1, the bottom wall 6 of the device base 4 is permanently sealed such that the interior of the base and the inner chamber 20 of the projection cannot be accessed. This is preferable when the inner chamber includes phase changing material that must remain within the chamber and not be exposed to exterior conditions. In a separate embodiment, as is shown in FIGS. 6 and 10-12, the lower end of the base includes a seal 452, and the base contains openings 456, as explained in further detail below. This is preferable when the material within the projection chamber is an activated carbon or other material that requires exposure to the surrounding environment to be activated. In this embodiment, when the seal is removed, air flows through the lower end of the base, through the interior of the base, and into the projection inner chamber activating the carbon and in turn providing a heating element.

Figure 2:
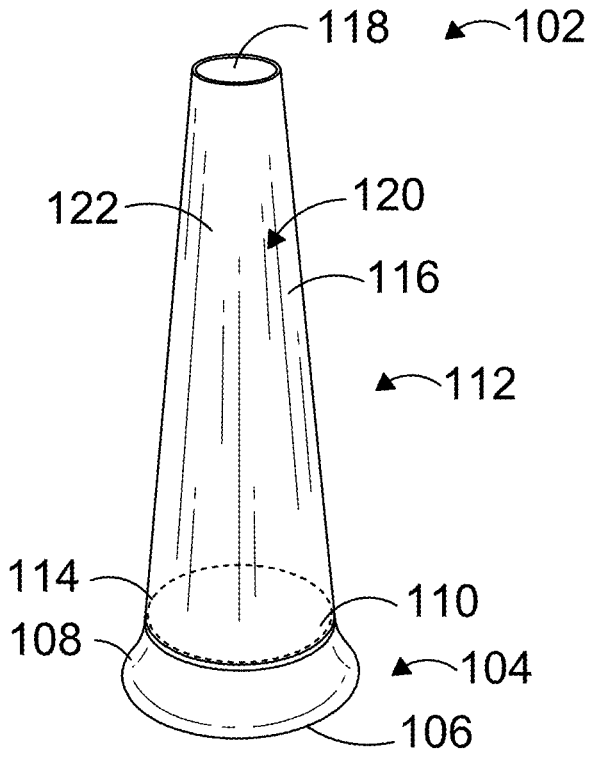
FIG. 2 is a perspective view of a second embodiment of a temperature control device according to the present disclosure.
Figure 3:
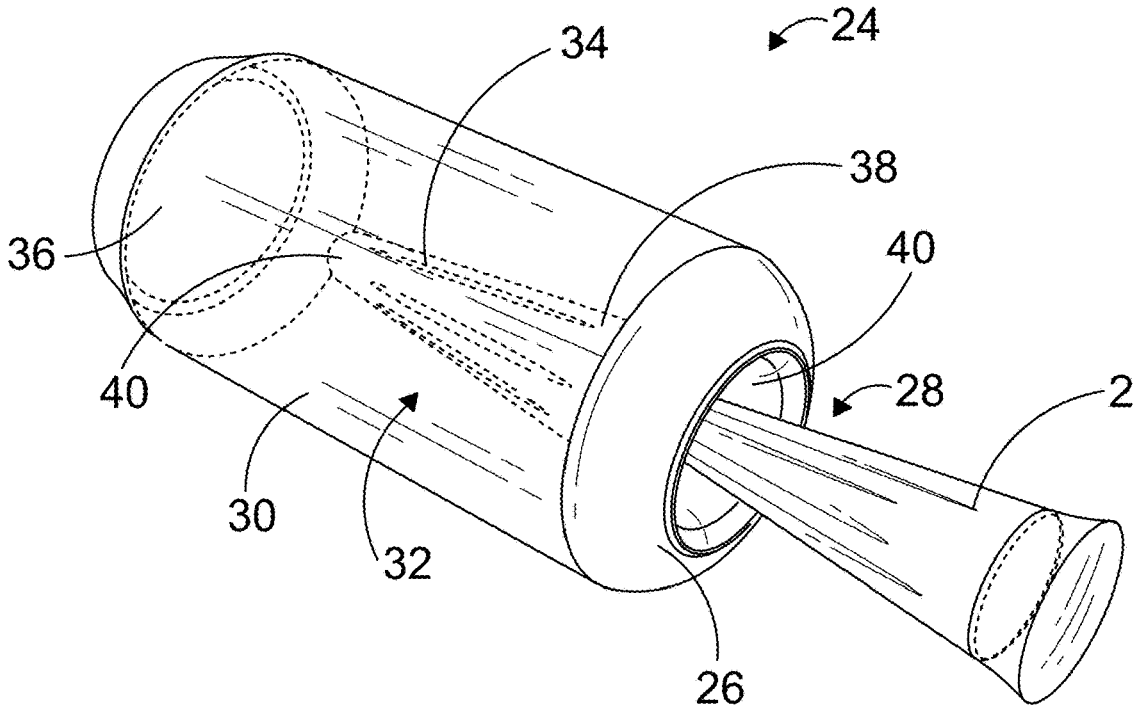
FIG. 3 is a perspective view of the temperature control device of FIG. 1 being inserted into a first container according to the present disclosure.
Figure 4:
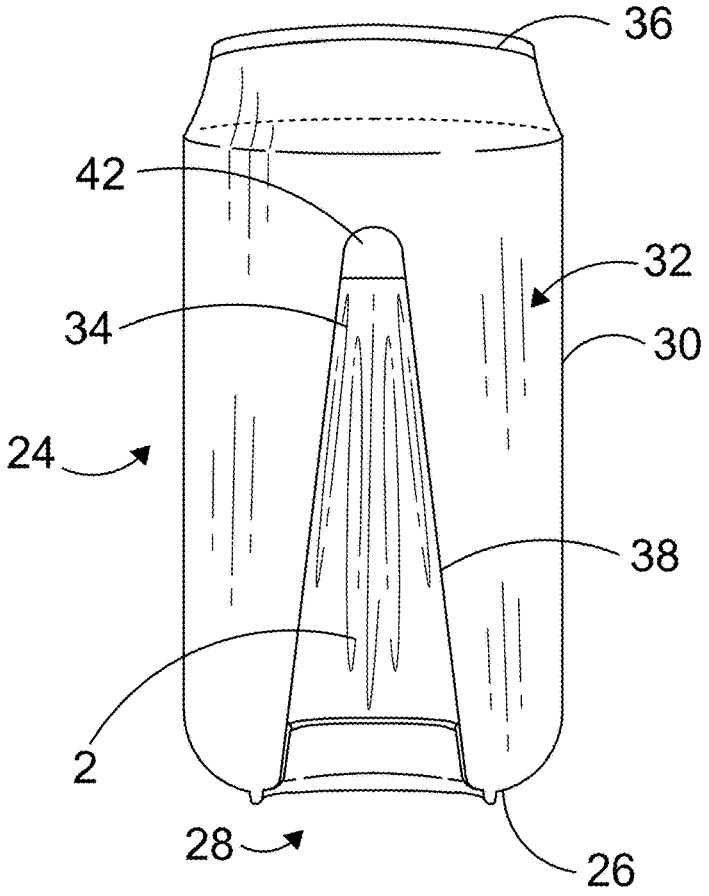
FIG. 4 is a cross-section view of the device and container of FIG. 3.
Figure 5:
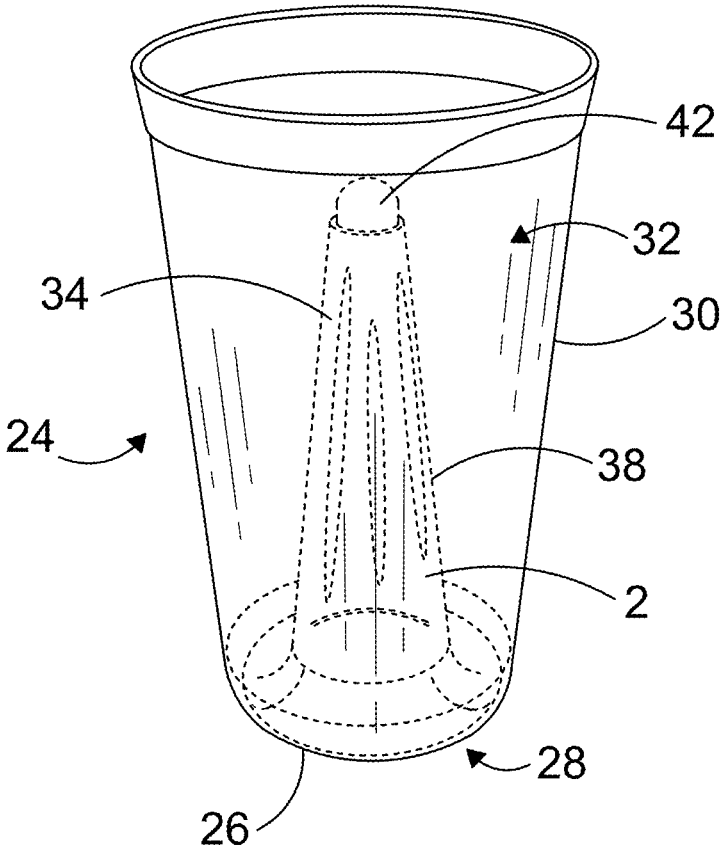
FIG. 5 is a perspective view of the temperature control device of FIG. 1 inserted into a second container.

As shown in FIGS. 3-5, when the temperature control device 2 is inserted into the lower end 28 of a drinking container 24 and secured therein, the device heats or cools liquid present within the container whether by absorbing or releasing heat. When the device of these embodiments is connected with the container, the device bottom wall 6 is coplanar with the container bottom wall 26. It will be understood by those with skill in the art that the device may extend below the container bottom wall or be inserted into the container opening such that the container bottom wall and device bottom wall are not coplanar. Moreover, the device bottom wall of FIGS. 1 and 2 have a planar, flat configuration. It will be understood by those with skill in the art that the device bottom wall may be non-planar without deviating from the spirit of the disclosure.

Referring now to FIG. 2, a second embodiment of a temperature control device 102 is shown. This embodiment also includes a base 104 having bottom 106, side 108 and top 110 walls, as well as a projection 112 connected with the base and extending therefrom. The projection in this embodiment has a smooth, non-fluted side wall 116, a frustoconical top wall 118, and a bottom wall 114. It will be understood by those with skill in the art that the configuration of the top wall and side wall of the projection may vary without deviating from the spirit of the device disclosed herein. As with the embodiment of FIG. 1, this embodiment includes a projection inner chamber 120 containing a temperature affecting material 122.

Referring again to FIGS. 3-5, embodiments for containers with the temperature control device of FIG. 1 are shown. Each container 24 includes a bottom wall 26 having a central opening 28 and side wall 30 defining an inner chamber 32, and a hollow projection 34 extending from the bottom wall toward an upper end of the container. The containers of FIGS. 3 and 4 also include a top wall 36.

The projections 34 have a first outer surface 38 that is exposed to the inner chamber 32 of the container 24 and a second outer surface 40 (FIG. 3) that is exposed to the hollow space defined by the projection 34 and lower end opening 28. The hollow projection of this container has a fluted configuration with a rounded, convex top 42. The temperature control device 2 of FIG. 1 is configured to correspond with the fluted projection of the container. When the temperature control device is inserted into the container, it either cools or heats the contents of the container depending on the material contained within the chamber of the device, as described above and shown in FIG. 1.

The container with central projection 24 of FIG. 5 is described in detail in the Cicarelli U.S. Pat. No. 11,116,340 the entire contents of which are incorporated herein by reference. The projection of this container is fluted, but it will be understood by those will skill in the art, and as described in the '340 patent, that varying contains with varying projection surface configurations could be implemented.

Figure 6:
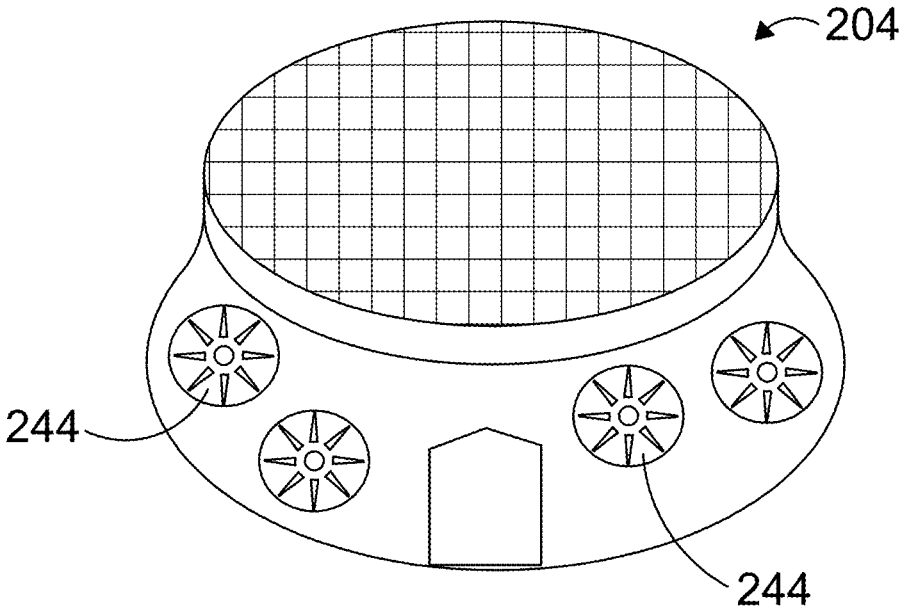
FIG. 6 is a perspective view of one embodiment of a base of a temperature control device according to the present disclosure.
Figure 7:
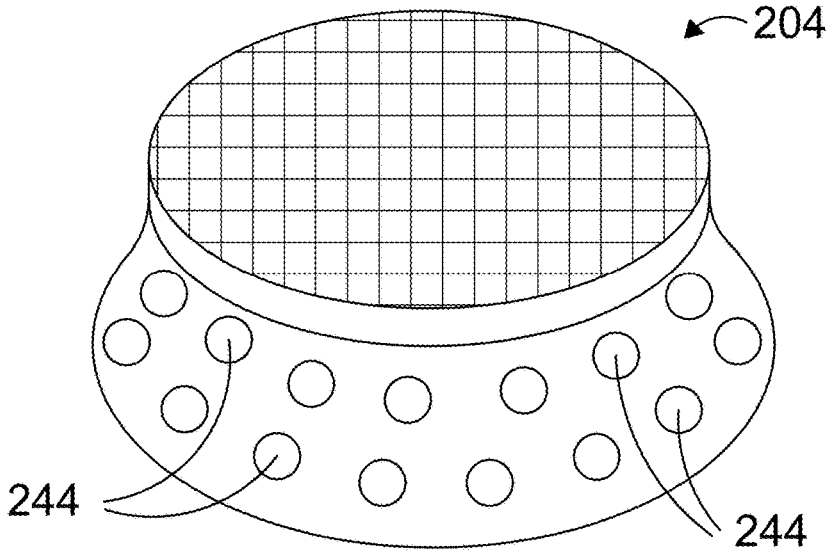
FIG. 7 is a perspective view of a second embodiment of a base of a temperature control device according to the present disclosure.

Referring now to FIGS. 6-9, friction fit mechanisms for connecting a temperature control device with a drinking container are shown. FIGS. 6 and 7 show bases 204 of a temperature control device having dimples 244. The embodiment of FIG. 6 includes fewer, larger dimples as compared to the embodiment of FIG. 7, which includes a greater number of smaller dimples 6. It will be understood by those with skill in the art that differing numbers and sizes of dimples can be included to secure a temperature control device with a container.

Figure 8:
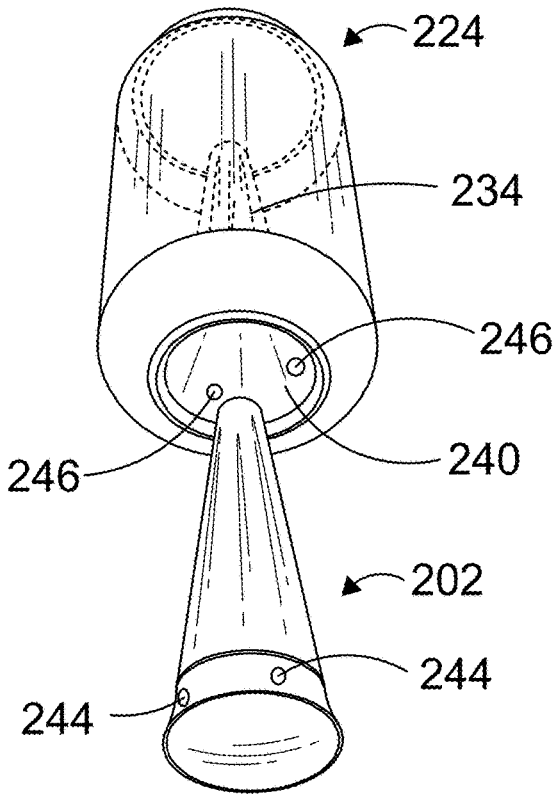
FIGS. 8 and 9 are perspective views of containers with temperature control devices according to the present disclosure.

As shown in FIG. 8, the inner surface 240 of the hollow projection 234 of a container 224 includes protrusions 246, some of which are not represented in this figure, configured to connect with dimples 244 and secure the device 202 in place.

Figure 9:
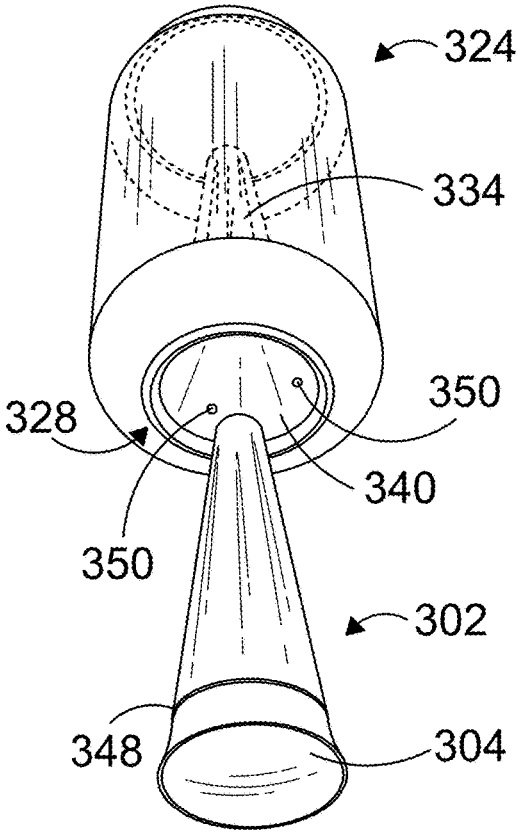

The embodiment of FIG. 9 includes a temperature control device 302 with a base 304 containing an annular notch 348 as the friction fit mechanism. The inner surface of the hollow projection 340 includes elongated protrusions 350 arranged to correspond with the annular notch such that when the temperature control device is inserted into the lower end opening 328 of the container 324, the notch engages with the protrusions to secure the device within the hollow projection 334 via a friction fit. The temperature control device then heats or cools the contents of the container inner chamber.

Figure 10:
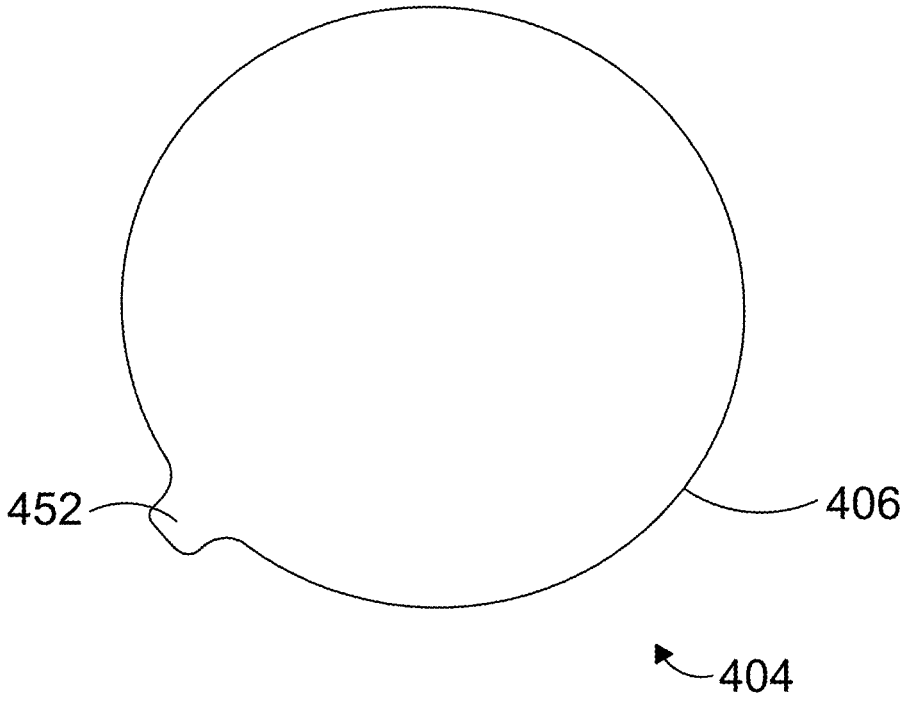
FIG. 10 is a bottom view of a base bottom wall of a temperature control device with a removable seal connected therewith according to the present disclosure.
Figure 11:
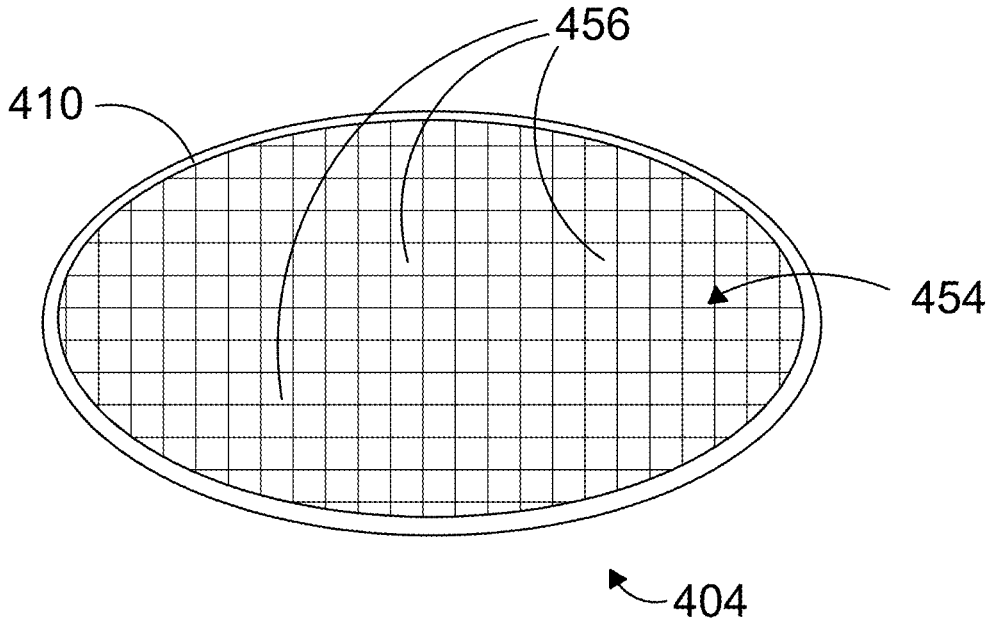
FIG. 11 is a top perspective view of a base top wall of a temperature control device according to the present disclosure.
Figure 12:
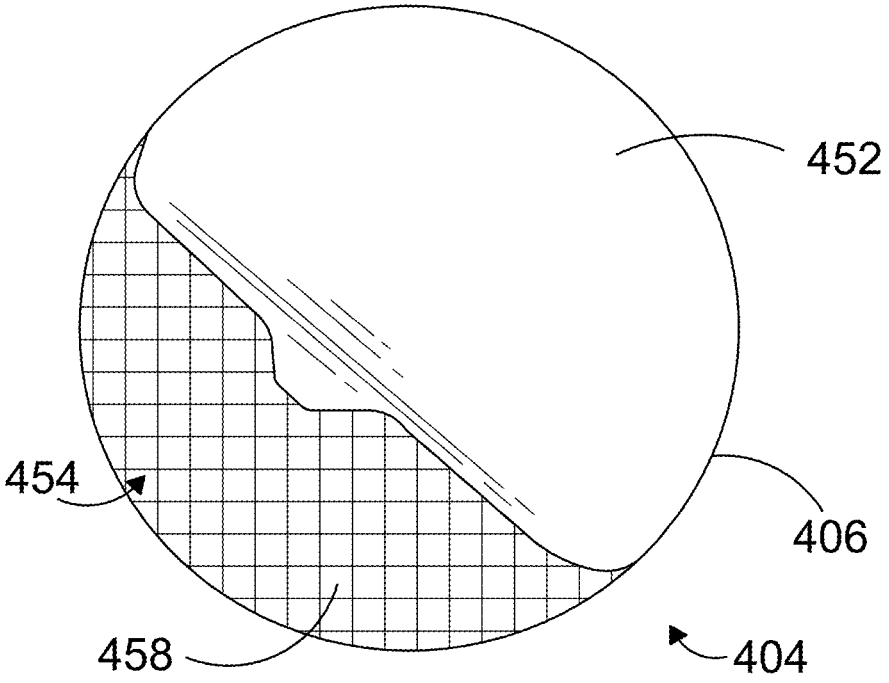
FIG. 12 is a bottom view of the base bottom wall of FIG. 10 with the seal partially removed.

Referring to FIGS. 10-12, the bottom 406 and top 410 walls of a temperature control device base 404 are shown. The bottom wall includes a removable seal 452, as shown in FIGS. 10 and 12, which is configured to prevent air flow from entering the base and thus the device inner chamber (not shown). When the seal is removed, the interior of the base 454 and interior of the device projection inner chamber (not shown) are exposed to the surrounding environment. As shown in FIG. 11, the base includes openings 456 which will allow air to pass through the base and into the projection inner chamber. Preferably, for this embodiment, the device inner chamber includes activated carbon, and when the seal is removed, the carbon is exposed to oxygen causing a chemical reaction and heat transfer from the device to its surrounding environment. When the device is inserted into a drinking container (FIGS. 3-5, 8 and 9), the heat transfers to the interior of the container affecting the contents within the container.

Figure 13:
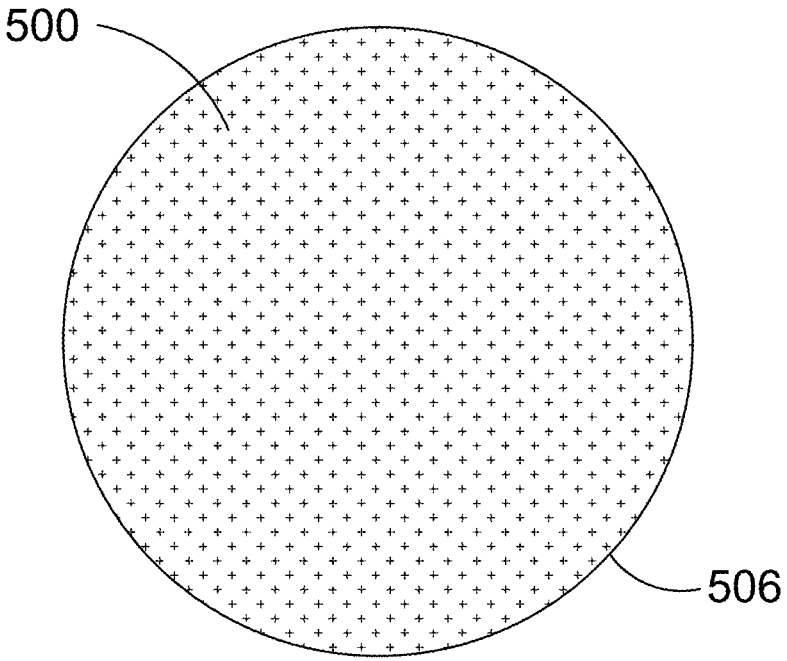
FIG. 13 is a bottom view of a base bottom wall with seal removed.

FIG. 12 shows an embodiment of a base bottom wall 406 that includes a lattice 458 through which air can pass. FIG. 13 shows an embodiment of a base bottom wall 506 with seal removed which includes a permeable material 560 through which air can pass. It will be understood by those will skill in the art that additional bottom wall configurations that allow air to pass through the base can be included without deviating from the spirit of the disclosure.

Although the above description is in reference to a particular embodiment, it is to be understood that the embodiment is merely illustrative of the principles and applications of the present disclosure. It is therefore to be understood that numerous modifications may be made to the illustrative embodiment and that other arrangements may be devised and employed without departing from the spirit and scope of the present disclosure.

What is claimed is:

1. A temperature control device for a container, comprising:

(a) A base having a bottom wall and at least one side wall, said base side wall having a progressively narrowing diameter from said bottom wall to an upper end of said at least one side wall;

(b) A projection connected with and extending from said base, said projection including a side wall and a top wall defining an inner chamber, said base and projection configured for connection with a lower end opening of a drink container; and (c) A temperature control substance contained within said inner chamber.

2. The temperature control device of claim 1, said base further having a top wall and said projection further having a bottom wall, said base bottom wall being planar.

3. The temperature control device of claim 1, wherein said projection has a generally conical configuration.

4. The temperature control device of claim 1, wherein said projection top wall has one of a convex, concave and frustoconical configuration.

5. The temperature control device of claim 1, wherein an outer surface of said base side wall contains a connection mechanism having a friction fit.

6. The temperature control device of claim 5, wherein said connection mechanism includes a base side wall annular notch arranged to correspond with at least one side wall protuberance of a drink container lower end opening.

7. The temperature control device of claim 5, wherein said connection mechanism includes a plurality of base side wall dimples arranged to correspond with a plurality of side wall protuberances of a drink container lower end opening.

8. The temperature control device of claim 1, wherein said temperature control substance includes a phase changing material.

9. The temperature control device of claim 1, wherein said temperature control substance includes an activated carbon, said base bottom wall including a removable seal to activate said activated carbon.

10. The temperature control device of claim 9, wherein said base bottom wall contains at least one opening.

11. The temperature control device of claim 9, wherein said base bottom wall includes a permeable material.

12. A container, comprising:

(a) a housing having a bottom wall containing a lower end opening, at least one side wall, and an open upper end defining a chamber;

(b) a hollow projection arranged within said chamber and integral with said bottom wall; and (c) a temperature control device configured for connection with said container, including:

i. a base having a bottom wall and at least one side wall, said base side wall having a progressively narrowing diameter from said bottom wall to an upper end of said at least one side wall;

ii. a device projection connected with and extending from said base, said device projection including a side wall, a bottom wall and a top wall defining an inner chamber, said base and said device projection being configured for connection with said hollow projection via said lower end opening; and iii. a temperature control substance contained within said inner chamber.

13. The container of claim 12, wherein an outer surface of said base side wall contains an annular notch arranged to correspond with at least one side wall protuberance arranged on a surface of said hollow projection.

14. The container of claim 12, wherein an outer surface of said base side wall contains a plurality of dimples arranged to correspond with a plurality of side wall protuberances arranged on a surface of said hollow projection.

15. The container of claim 12, wherein said temperature control substance includes a phase changing material.

16. The container of claim 12, wherein said temperature control substance includes an activated carbon, said base bottom wall including a removable seal to activate said activated carbon.

17. The container of claim 16, wherein said base bottom wall contains at least one opening.

18. The container of claim 16, wherein said base bottom wall includes a permeable material.

* * * * *